US011248335B2

(12) United States Patent
Javit et al.

(10) Patent No.: US 11,248,335 B2
(45) Date of Patent: Feb. 15, 2022

(54) SMOOTHING HEAD COMPRISING AN INNER CHAMBER PROVIDED WITH STEAM DISCHARGE DUCTS

(71) Applicant: SEB S.A., Ecully (FR)

(72) Inventors: Maxime Javit, Lyons (FR); Valentin Javelle, Chonas l'Amballan (FR)

(73) Assignee: SEB S.A.

( * ) Notice: Subject to any disclaimer, the term of this patent is extended or adjusted under 35 U.S.C. 154(b) by 393 days.

(21) Appl. No.: 16/151,626

(22) Filed: Oct. 4, 2018

(65) Prior Publication Data

US 2019/0106836 A1 Apr. 11, 2019

(30) Foreign Application Priority Data

Oct. 5, 2017 (FR) ..... 1759362

(51) Int. Cl.

| | |
|---|---|
| ***D06F 73/00*** | (2006.01) |
| ***D06F 87/00*** | (2006.01) |
| ***D06F 75/12*** | (2006.01) |
| ***D06F 75/18*** | (2006.01) |
| ***D06F 75/20*** | (2006.01) |

(52) U.S. Cl.

CPC ..... *D06F 73/00* (2013.01); *D06F 75/12* (2013.01); *D06F 87/00* (2013.01); *D06F 75/18* (2013.01); *D06F 75/20* (2013.01)

(58) Field of Classification Search

CPC ..... D06F 73/00; D06F 75/12; D06F 75/18; D06F 75/20; D06F 87/00; A61H 33/12; A47G 25/72; D06C 7/00; F22B 1/30

See application file for complete search history.

(56) References Cited

U.S. PATENT DOCUMENTS

2003/0000116 A1* 1/2003 Yao ..... D06F 75/06 38/77.6
2008/0034813 A1* 2/2008 Tobias ..... D06F 87/00 68/222

(Continued)

FOREIGN PATENT DOCUMENTS

CN 105463816 A 4/2016
EP 1 923 499 A1 5/2008

(Continued)

OTHER PUBLICATIONS

English translation of CN105463816 cited on applicant's IDS, original document published Apr. 6, 2016.*

(Continued)

*Primary Examiner* — Nathan E Durham
*Assistant Examiner* — Abby M Spatz
(74) *Attorney, Agent, or Firm* — Lerner, David, Littenberg, Krumholz & Mentlik, LLP

(57) ABSTRACT

A smoothing head includes a steam distribution circuit containing an inlet duct including an inlet opening connected to a steam pipe; and a front wall equipped with a treatment face including at least one steam outlet hole and intended to face a garment to be smoothed. The inlet duct includes an outlet opening leading to an inner chamber belonging to the steam distribution circuit, the inner chamber including a condensate evacuation opening communicating with a condensate return circuit leading to the steam pipe or to the inlet duct.

20 Claims, 4 Drawing Sheets

(56) References Cited

U.S. PATENT DOCUMENTS

| | | | | |
|---|---|---|---|---|
| 2012/0042547 | A1* | 2/2012 | Pang | F22B 1/28 38/77.6 |
| 2014/0345334 | A1* | 11/2014 | Chua | D06F 75/00 68/5 B |
| 2015/0252518 | A1 | 9/2015 | Fung et al. | |
| 2017/0268160 | A1* | 9/2017 | Chua | D06F 75/10 |

FOREIGN PATENT DOCUMENTS

| | | | |
|---|---|---|---|
| EP | 2 251 482 | A1 | 11/2010 |
| EP | 2 610 404 | A1 | 7/2013 |
| WO | WO 2017/108440 | A1 | 6/2017 |

OTHER PUBLICATIONS

Search Report as issued in French Patent Application No. 1759362, dated Mar. 29, 2018.

* cited by examiner

SMOOTHING HEAD COMPRISING AN INNER CHAMBER PROVIDED WITH STEAM DISCHARGE DUCTS

CROSS-REFERENCE TO RELATED APPLICATIONS

This application claims priority to French Patent Application No. 1759362, filed Oct. 5, 2017, the entire content of which is incorporated herein by reference in its entirety.

FIELD

This invention relates to a smoothing head of a steam-smoothing apparatus.

BACKGROUND

In a manner known per se, a steam-smoothing apparatus comprises a base unit intended to produce a steam flow, and a smoothing head connected to the base unit by a steam pipe, in which the steam produced by the base unit freely escapes towards the smoothing head, the smoothing head comprising a rear portion forming a gripping handle, and a front portion comprising a front wall including a treatment face intended to face a garment to be smoothed, and equipped with several steam outlet holes through which the steam flow from the base unit is diffused.

During the use of such a smoothing head, water drops carried by the steam flow generated by the base unit are likely to be sprayed or absorbed by capillarity through the at least one steam outlet hole and thus to stain the garment or linen to be smoothed.

SUMMARY

An aspect of the invention aims to remedy this disadvantage.

A technical problem on which the invention is based consists in particular of providing a smoothing head with a simple and economical structure, while limiting the risk that water drops may be sprayed or absorbed by capillarity on a garment or linen to be smoothed.

For this purpose, an aspect of the invention concerns a smoothing head comprising a steam distribution circuit and a front wall equipped with a treatment face intended to face a garment to be smoothed, the treatment face comprising at least one steam outlet hole, the steam distribution circuit comprising an inlet duct including an inlet opening intended to be connected to a steam pipe, wherein the steam distribution circuit also comprises an inner chamber and wherein the inlet duct comprises an outlet opening leading to the inner chamber, the inner chamber comprising a condensate evacuation opening communicating with a condensate return circuit leading to the steam pipe or to the inlet duct.

Such a configuration of the smoothing head, and more particularly the presence of a condensate evacuation opening in the inner chamber, allows the condensates that may have formed in the inner chamber to be evacuated to the outside of the inner chamber, and thus limits the risk that water drops may be sprayed and/or absorbed by capillarity through the at least one steam outlet hole. In fact, such evacuation of condensates prevents the steam flow circulating in the inner chamber from becoming loaded with water droplets and prevents such water droplets from being discharged through the at least one steam outlet hole.

In addition, the fact that the condensate return circuit leads to the steam circuit or to the inlet duct makes it possible, using a device that is simple and economical to implement, to redirect the condensates, evacuated out of the inner chamber, into the steam pipe, such that the condensates slide by gravity along the steam pipe and fall back into the steam generator of the base unit where they will then be revaporized. In particular, thanks to this solution, the steam pipe is used to bring the condensates back toward the steam generator, and it is not necessary to use a specific condensate return circuit, dedicated to this function only and costly to implement.

In addition, the configuration of the condensate return circuit avoids any additional manipulation for the user in order to drain the inner chamber or any collector connected to the inner chamber and with which the smoothing head may be provided.

Thus, the smoothing head according to an aspect of the invention has the benefit of being simple and economical to make, while greatly limiting the risk that water drops may be sprayed on a garment or linen to be smoothed.

The smoothing head may in addition have one or more of the following characteristics, taken alone or in combination.

According to an embodiment of the invention, the outlet opening leads to the inner chamber at a suitable location so that the trajectory of the water drops carried by the steam flow, and sprayed into the inner chamber at the outlet opening, does not pass through the at least one steam outlet hole.

According to an embodiment of the invention, the condensate evacuation opening is arranged at a location toward which the water in the inner chamber naturally flows by gravity when the smoothing head is oriented in a usual position of use.

According to an embodiment of the invention, the treatment face is flat and has a generally triangular contour.

According to an embodiment of the invention, the inlet duct has a constant flow cross section. This configuration of the inlet duct ensures a constant speed of the steam throughout its path in the inlet duct, preventing it from cooling by expansion in a larger space.

According to an embodiment of the invention, the inlet duct has a circular flow cross section at the inlet opening and a flattened flow cross section at the outlet opening.

According to an embodiment of the invention, the inlet duct has a 90° elbow upstream of the outlet opening. The presence of such an elbow causes an acceleration of the steam flow flowing into the inlet duct, and thus favors the separation of the water drops which are carried by the steam flow, from the steam flow. These separated water drops are more particularly sprayed onto an outer wall of the elbow, and are then blown by the steam flow along the front wall and away from the outlet opening.

According to an embodiment of the invention, the elbow has an inner bend radius of between 3.5 and 4.5 mm and an outer bend radius of between 9 and 11 mm. Beneficially, the elbow has an inner bend radius of 4 mm and an outer bend radius of 10 mm.

According to an embodiment of the invention, the inner chamber comprises a first diffusion chamber arranged between an inner face of the front wall and a first face of a partition wall extending inside the inner chamber, and a second diffusion chamber partially defined by a second face of the partition wall opposite the first face of the partition wall, the second diffusion chamber being in communication with the first diffusion chamber.

According to an embodiment of the invention, the outlet opening leads to the inner chamber tangentially to the front wall, such that the steam exiting the outlet opening flows along the front wall.

According to an embodiment of the invention, the outlet opening leads to an upper part of the inner chamber, and, in an embodiment, in the vicinity of the top of the inner chamber.

According to an embodiment of the invention, the outlet opening leads to the first diffusion chamber, and in the vicinity of the top of the first diffusion chamber, for example.

According to an embodiment of the invention, the inner chamber comprises steam discharge ducts extending transversely to the front wall and communicating with the at least one steam discharge hole such that the steam in the inner chamber escapes through the steam discharge ducts and towards the at least one steam outlet hole. Such a configuration of the steam discharge ducts requires circulation of steam in the inner chamber before the steam can enter the steam discharge ducts, which favors the separation of at least a portion of the water drops carried by the steam, from the steam flow, and thus limits the risk that water drops may be sprayed through the at least one steam outlet hole.

According to an embodiment of the invention, the first diffusion chamber is crossed by the steam discharge ducts, the steam discharge ducts projecting from the inner face of the front wall and leading to the second diffusion chamber. Such a configuration of the steam discharge ducts implies that the steam entering the inner chamber flows around the steam discharge ducts, and thus that the latter are heated before the steam escapes from the smoothing head via the steam discharge ducts and the at least one steam outlet hole. Such heating of the steam discharge ducts greatly limits the condensation of water drops on the inner walls of the steam discharge ducts, and thus the spraying of water drops through the at least one steam outlet hole.

According to an embodiment of the invention, the steam discharge ducts extend substantially perpendicularly to the front wall.

According to an embodiment of the invention, the outer surface of each steam discharge duct comprises ribs, for example longitudinal ones, so as to increase the heat exchange surface area between the steam and the steam discharge duct. The outer surface of each steam discharge duct may, for example, be crenelated.

According to an embodiment of the invention, the treatment face comprises several steam outlet holes, and each steam discharge duct coincides with a respective steam outlet hole.

According to an embodiment of the invention, the steam discharge ducts have a total flow cross section substantially corresponding to the flow cross section of the inlet duct.

According to an embodiment of the invention, each steam discharge duct has an oblong flow cross section that presents a diminishing width opposite the outlet opening.

According to an embodiment of the invention, each steam discharge duct has a flow cross section in the shape of a water drop pointing away from the outlet opening, and for example pointing downwards.

According to an embodiment of the invention, each steam discharge duct comprises a barrier rib which projects inside said steam discharge duct and forms a barrier against the flow of water drops along said steam discharge duct towards the at least one steam outlet hole. These arrangements further participate in preventing the spraying of water droplets through the at least one steam outlet hole.

Beneficially, the barrier rib of each steam discharge duct is arranged substantially at one extremity of the respective steam discharge duct turned towards the at least one steam outlet hole.

According to an embodiment of the invention, each steam discharge duct comprises a lower opening leading to the inner chamber, and, in an embodiment, to the first diffusion chamber. These arrangements allow some condensates that may form in each steam discharge duct to be evacuated toward the inner chamber, which further limits the risks that water droplets may be sprayed to the outside of the smoothing head via the at least one steam outlet hole.

According to an embodiment of the invention, the condensate evacuation opening is arranged at the base of the inner chamber.

According to an embodiment of the invention, the inner chamber comprises a lower wall containing the condensate evacuation opening. The condensate evacuation opening is, for example, arranged in a central portion of the lower wall of the inner chamber.

According to an embodiment of the invention, the lower wall is curved. These arrangements further favor a separation of at least a portion of the water drops carried by the steam flowing into the inner chamber, from the steam flow, and further limit the risk that water drops may be sprayed through the at least one steam outlet hole. In fact, the largest water drops transported by the steam remain stuck against the curve surface due to centrifugal force.

According to an embodiment of the invention, the condensate return circuit has a condensate storage cavity arranged in the smoothing head, beneficially under the lower wall of the inner chamber.

According to an embodiment of the invention, the condensate storage cavity is arranged such that, when the smoothing head is tilted relative to the horizontal, a wall of the condensate storage cavity prevents the condensates contained in the condensate storage cavity from flowing into the inner chamber.

According to an embodiment of the invention, the steam discharge ducts are situated at a distance from the condensate evacuation opening, and beneficially from the condensate storage cavity.

According to an embodiment of the invention, the first diffusion chamber has a flow cross section gradually diminishing according to the direction of circulation of the steam in the first diffusion chamber. These arrangements accelerate the steam flowing into the first diffusion chamber, and thus favor the blowing of condensates away from the inlet opening, and in particular toward the condensate evacuation opening.

According to an embodiment of the invention, the condensate evacuation opening leads to the condensate storage cavity.

According to an embodiment of the invention, the condensate return circuit comprises a return duct including a first extremity portion connected fluidically to the condensate evacuation opening, and a second extremity portion opposite the first extremity portion and projecting into the steam pipe or into the inlet duct, for example by a few millimeters. These arrangements in particular prevent any condensate that may flow along the inner wall of the inlet duct towards the inlet opening of the inlet duct or along the inner wall of the steam pipe towards the steam generator, from entering the return duct and filling it.

According to an embodiment of the invention, the second extremity portion of the return duct projects into the inlet duct close to the inlet opening of the inlet duct.

Beneficially, the second extremity portion of the return duct is beveled. These arrangements allow the liquid flowing from the return duct to be directed toward the tip of the latter and thus help to relieve congestion in the return duct. In addition, this beveled shape of the return duct facilitates the passage of the steam flow, flowing into the inlet duct on both sides of this obstacle. The fact that the return duct is beveled also partially prevents steam from entering the return duct during the first passage of steam into the smoothing head (during conventional operation, the presence of water in the return duct prevents steam from going up into the latter).

According to an embodiment of the invention, the inlet duct is configured to be tilted relative to the horizontal when the front wall extends substantially vertically.

These arrangements favor a flow of the condensates contained in the condensate storage cavity towards the steam pipe or the inlet duct, and thus avoid an accumulation of condensates in the condensate storage cavity.

According to an embodiment of the invention, the return duct has a substantially constant flow cross section.

According to an embodiment of the invention, the first extremity portion of the return duct leads to the condensate storage cavity.

According to an embodiment of the invention, the smoothing head comprises a main body at least partially defining the inner chamber, and a soleplate connected to the main body and including the front wall. The soleplate may in addition comprise the steam discharge ducts. Beneficially, the soleplate is in one piece and is made of plastic material.

According to an embodiment of the invention, the soleplate also comprises the partition wall.

According to an embodiment of the invention, the main body comprises a stop surface against which the partition wall rests.

According to an embodiment of the invention, the smoothing head comprises a cleaning opening leading to the condensate storage cavity, and the front wall releasably closes the cleaning opening.

According to an embodiment of the invention, the main body comprises an inner cavity and an access opening leading to the inner cavity, the front wall closing, for example in a releasable manner, the access opening. Beneficially, the inner chamber is defined by the inner walls of the inner cavity and the front wall.

According to an embodiment of the invention, the inlet duct comprises at least one guiding rib extending over at least a portion of the length of the inlet duct and configured to guide the steam flowing into the inlet duct.

An aspect of the invention also concerns a smoothing apparatus comprising a base unit provided with a steam generator and a smoothing head as previously described.

BRIEF DESCRIPTION OF THE DRAWINGS

The invention will be more fully understood with the assistance of the following description in reference to the attached schematic drawings representing, as non-restrictive examples, several forms of execution of this smoothing head.

DETAILED DESCRIPTION

Figure 1:
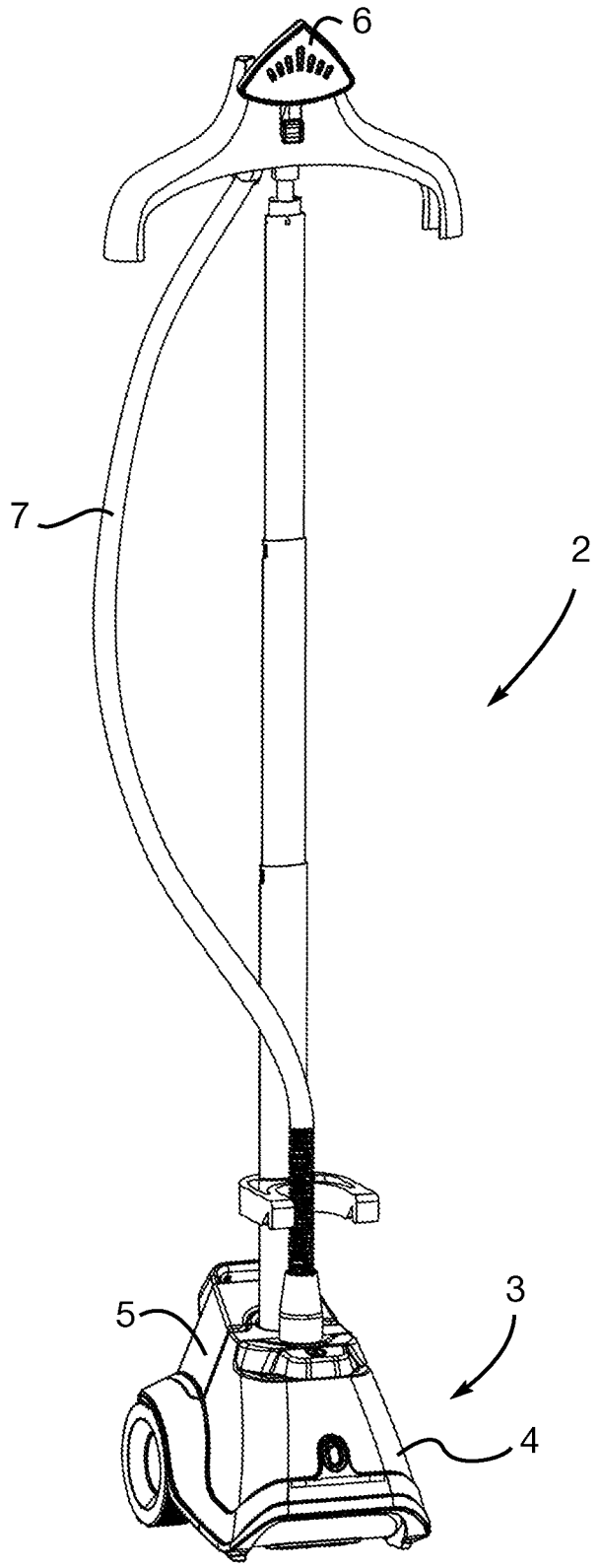
FIG. 1 is a perspective view of a steam-smoothing apparatus according to a first embodiment of the invention.

Note that in this document, the terms "lower," "upper," "front" and "rear" used to describe the smoothing apparatus refer to this smoothing apparatus when a soleplate of the latter extends vertically and is in normal conditions of use.

FIGS. 1 to 7 represent a smoothing apparatus 2 according to a first embodiment of the invention.

The smoothing head 2 comprises a base unit 3 provided with a liquid reservoir 4 and a steam generator 5, and a smoothing head 6 connected by a steam pipe 7, for example a flexible one, to the base unit 3, such that the steam produced by the steam generator 5 escapes freely towards the smoothing head 6 via the steam pipe 7.

Figure 2:
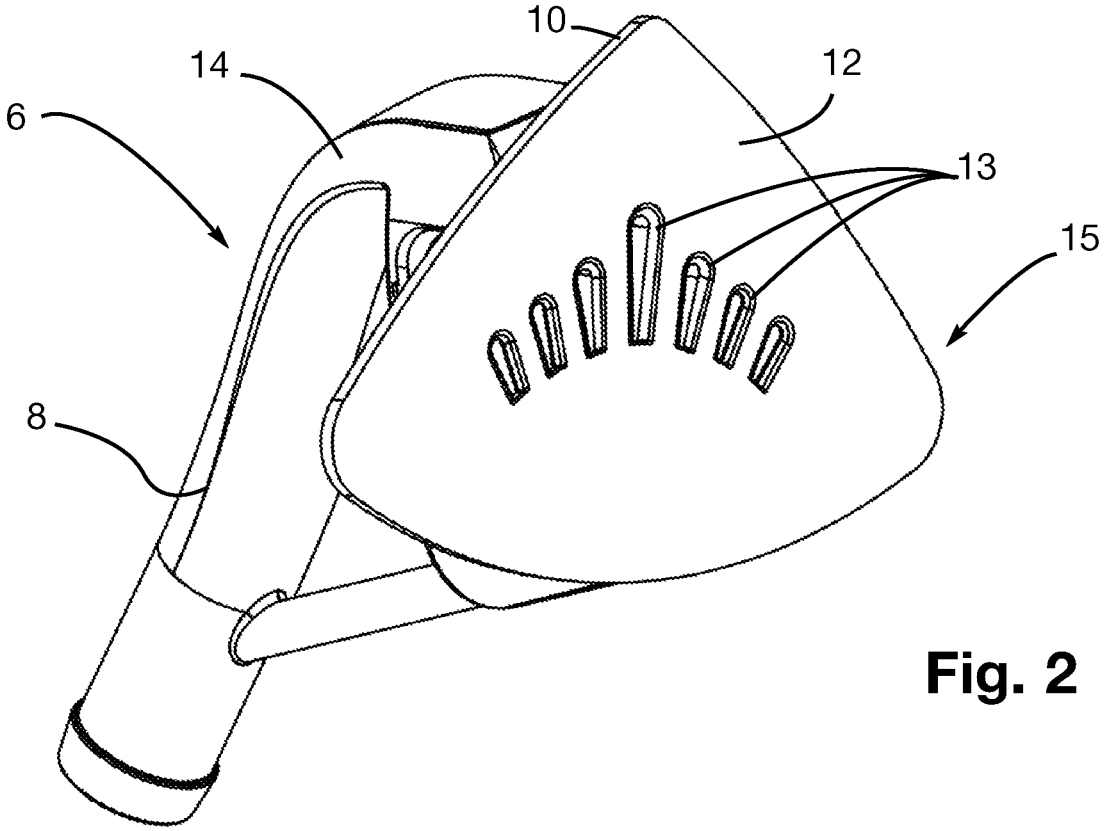
FIG. 2 is a perspective view of a smoothing head belonging to the smoothing apparatus in FIG. 1.
Figure 3:
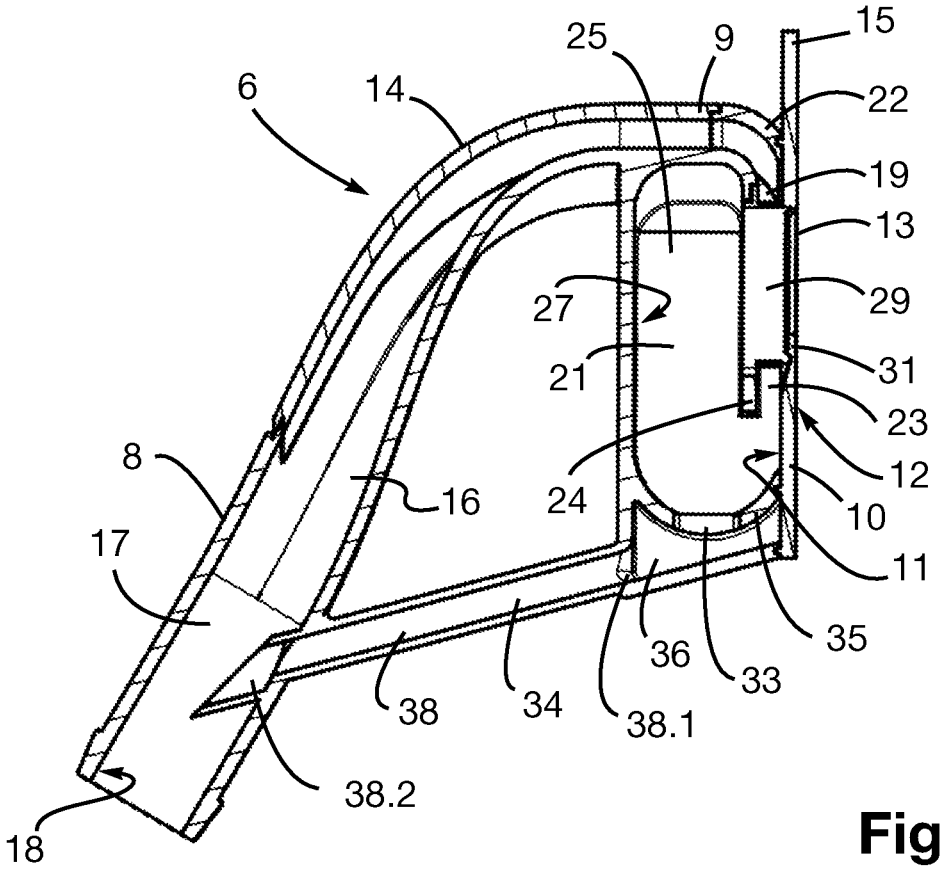
FIG. 3 is a longitudinal cross-sectional view of the smoothing head in FIG. 2.
Figure 4:
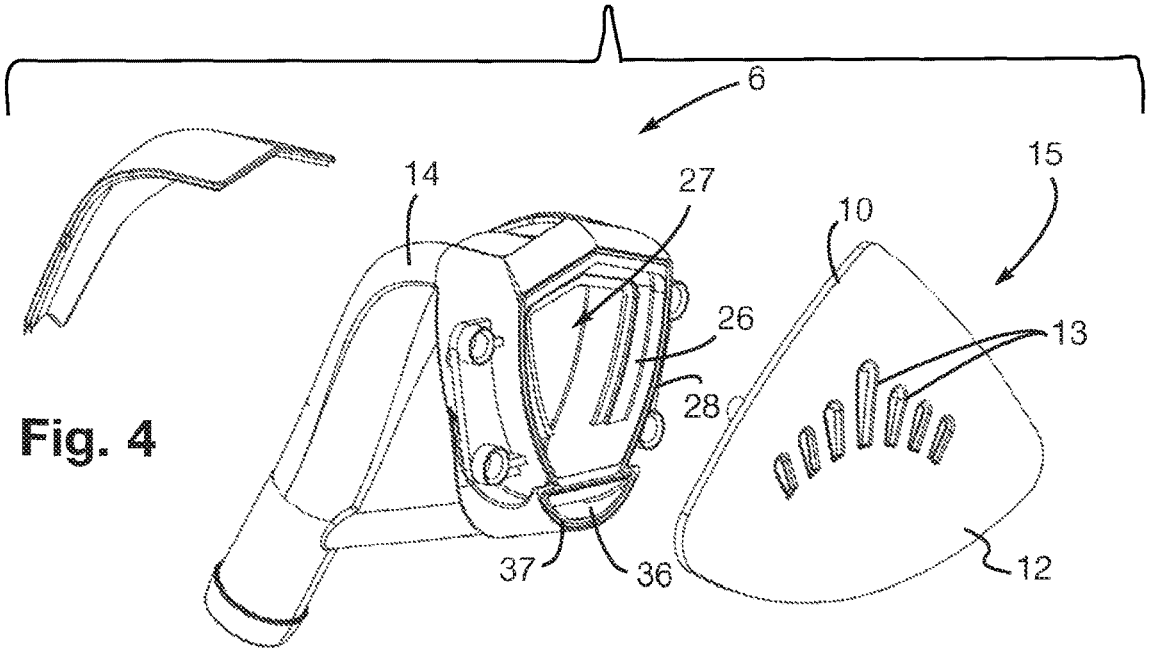
FIG. 4 is an exploded perspective view of the smoothing head in FIG. 2.

As shown more particularly in FIGS. 2 and 3, the smoothing head 6 comprises a rear part 8 forming a gripping handle, and a front part 9 including a front wall 10 equipped with an inner face 11 and a treatment face 12 intended to face a garment to be smoothed and comprising at least one steam outlet hole 13. According to the embodiment represented in FIGS. 1 to 7, the treatment face 12 is equipped with a plurality of steam outlet holes 13, and has a generally triangular contour, with curved edges. Beneficially, the treatment face 12 is flat.

According to the embodiment represented in FIGS. 1 to 7, the rear part 8 and the front part 9 of the smoothing head 6 are formed by the assembly of a main body 14 made of plastic material, and of a soleplate 15, also made of plastic material, which comprises the front wall 10 and which is connected to the main body 14 by screwing, for example, or by any other fixing system.

The smoothing head 6 also comprises a steam distribution circuit 16 containing an inlet duct 17 comprising an inlet opening 18 connected to the steam pipe 7 and an outlet opening 19. The steam distribution circuit 16 also comprises an inner chamber 21 to which the outlet opening 19 leads. Beneficially, the outlet opening 19 leads to the inner chamber 21 tangentially to the front wall 10, and, for example, in the vicinity of the top of the inner chamber 21, such that the steam coming from the steam pipe 7 and exiting the outlet opening 19 flows along the front wall 10. The inlet duct 17 beneficially has a constant flow cross section, which may be circular, for example, at the inlet opening 18 and which may, for example be flattened at the outlet opening 19.

According to the embodiment represented in FIGS. 1 to 7, the inlet duct 17 has a 90° elbow 22 which is situated upstream of the outlet opening 19. The elbow 22 may, for example, have an inner bend radius of about 4 mm and an outer bend radius of about 10 mm.

As shown more particularly in FIG. 3, the inner chamber 21 comprises a first diffusion chamber 23 arranged between the inner face 11 of the front wall 10 and a first face 24.1 of a partition wall 24 extending inside the inner chamber 21, and a second diffusion chamber 25 in communication with the first diffusion chamber 23 and partially defined by a second face 24.2 of the partition wall 24 opposite the first face 24.1 of the partition wall 24. According to the embodiment represented in FIGS. 1 to 7, the outlet opening 19 leads to the first diffusion chamber 23, and the first diffusion chamber 23 has a flow cross section gradually diminishing according to the direction of circulation of the steam in the first diffusion chamber 23. Beneficially, the main body 14 comprises a stop surface 26 (see FIG. 4) against which the partition wall 24 rests, and the partition wall 24 extends substantially parallel to the front wall 10.

According to the embodiment represented in FIGS. 1 to 7, the inner chamber 21 is defined by the inner walls of an inner cavity 27, arranged in the main body 14 and by the inner face of the front wall 10. The main body 14 may possibly comprise an access opening 28 which leads to the inner cavity 27 and which is closed, for example in a releasable manner, by the front wall 10.

Figure 5:
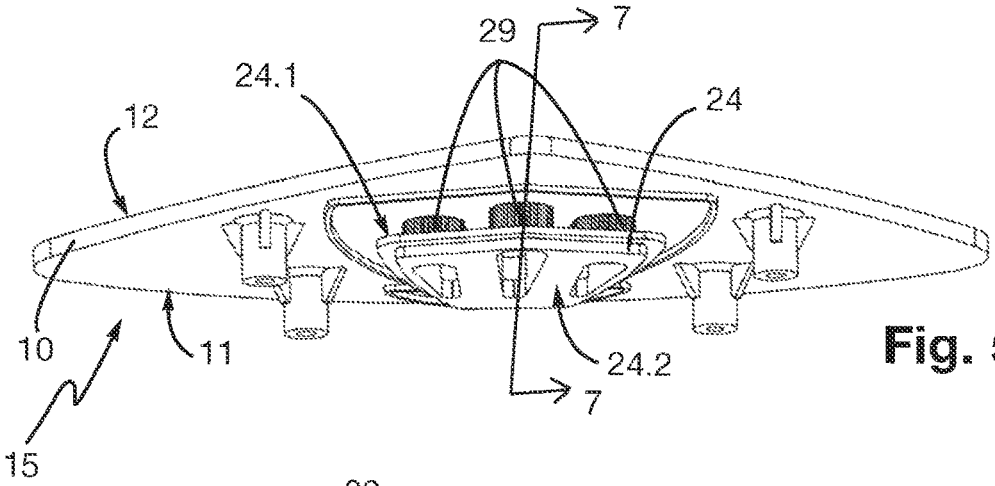
FIG. 5 is a top view of a soleplate of the smoothing head in FIG. 2.
Figure 6:
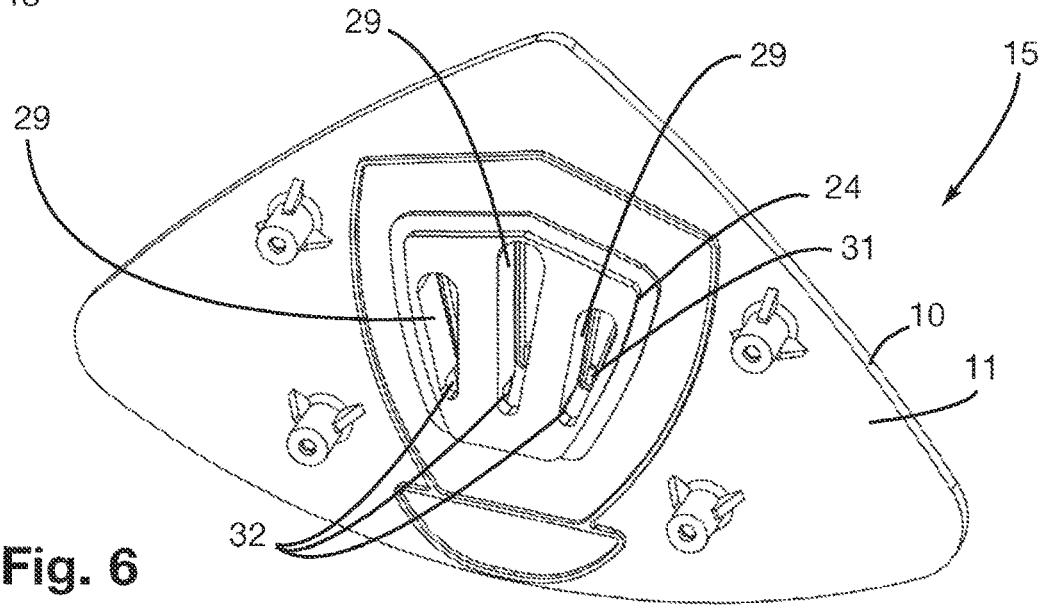
FIG. 6 is a perspective view of the soleplate in FIG. 5.
Figure 7:
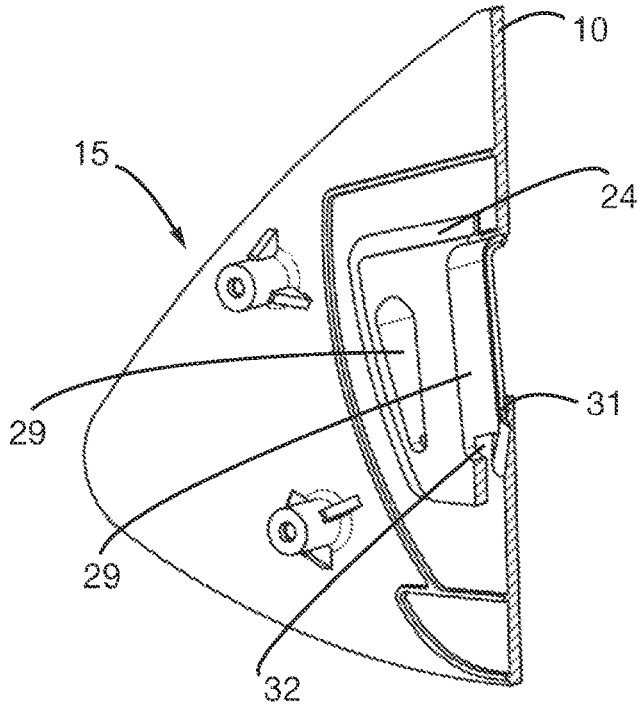
FIG. 7 is a perspective cross-sectional view of the soleplate in FIG. 5.

As shown in FIGS. 3, 5 and 6, the inner chamber 21 comprises steam discharge ducts 29 extending transversely to the front wall 10, and beneficially perpendicularly to the front wall and communicating with the steam discharge holes 13, such that the steam in the inner chamber 21 escapes through the steam discharge ducts 29 and towards the steam outlet holes 13. Beneficially, the first diffusion chamber 23 is crossed by the steam discharge ducts 29, and the steam discharge ducts 29 project from the inner face of the front wall 10 and lead to the second diffusion chamber 25. Beneficially, the steam discharge ducts 29 have a total flow cross section substantially corresponding to the flow cross section of the inlet duct 17.

According to the embodiment represented in FIGS. 1 to 7, each steam discharge duct 29 coincides with a respective steam outlet hole 13, and the soleplate 15 comprises the steam discharge ducts 29 and the partition wall 24.

Each steam discharge duct 29 has, in an embodiment, an oblong flow cross section which presents a diminishing width opposite the outlet opening 19, and more particularly downwards. These arrangements favor redirection of some water droplets that may have condensed on the inner walls of each steam discharge duct 29 towards a lower part of the latter.

According to the embodiment represented in FIGS. 1 to 7, each steam discharge duct 29 comprises a barrier rib 31 which projects inside the respective steam discharge duct 29, being beneficially tilted towards the inside of the inner chamber 21, and which forms a barrier against the flow of water droplets along the respective steam discharge duct 29 towards the steam outlet holes 13, and more particularly towards the respective steam outlet hole 13.

As shown in FIG. 6, each steam discharge duct 29 comprises a lower opening 32 leading to the inner chamber 21, and, in an embodiment, to the first diffusion chamber 23. In addition, as shown in FIG. 5, the outer surface of each steam discharge duct 29 beneficially comprises ribs, for example longitudinal ones, so as to increase the heat exchange surface area between the steam circulating in the first diffusion chamber 23 and the steam discharge duct 29. The outer surface of each steam discharge duct 29 may, for example, be crenelated.

As shown more particularly in FIG. 3, the inner chamber 21 also comprises a condensate evacuation opening 33 communicating with a condensate return circuit 34. Beneficially, the inner chamber 21 includes a lower wall 35, for example a curved one, in which the condensate evacuation opening 33 is arranged.

The condensate return circuit 34 beneficially comprises a condensate storage cavity 36 arranged in the smoothing head 6 and, for example, in the main body 14. The condensate storage cavity 36 is more particularly arranged under the curved lower wall 35 of the inner chamber 21, and the condensate evacuation opening 33 leads to the condensate storage cavity 36. Beneficially, the smoothing head 6 comprises a cleaning opening 37 (see FIG. 4) leading to the condensate storage cavity 36, and the front wall 10 releasably closes and seals the cleaning opening 37.

According to the embodiment represented in FIGS. 1 to 7, the condensate return circuit 34 also comprises a return duct 38 including a first extremity portion 38.1 leading to the condensate storage cavity 36, and a second extremity portion 38.2 opposite the first extremity portion 38.1 and leading to the inlet duct 17, for example, close to the inlet opening 18 of the inlet duct 17. The second extremity portion 38.2 of the return duct 38 may, for example, be beveled and project by a few millimeters into the inlet duct 17. However, according to an embodiment variant of the invention not shown in the figures, the second extremity portion 38.2 could lead to the steam pipe 7.

As shown more particularly in FIG. 3, the return duct 38 is configured to be tilted relative to the horizontal when the front wall 10 extends substantially vertically. The return duct 38 may beneficially have a substantially constant flow cross section.

The operation of the smoothing apparatus 2 thus realized will now be described.

When a user wishes to smooth a garment, he fills the liquid reservoir 4 of the base unit 3 with water, for example, and then pushes on a start button of the smoothing apparatus 2. The steam generator 5 is then electrically powered so as to generate the steam that escapes from the steam generator 5 towards the inlet opening 18 of the inlet duct 17. The steam coming from the steam generator 5 then flows along the inlet duct 17, enters the inner chamber 21 via the outlet opening 19 and is distributed over a significant portion of the width of the inner face of the front wall 10, because the inlet duct 17 has a flattened flow cross section at the outlet opening 19. Then, the steam having entered the inner chamber 21 flows towards the base of the inner chamber 21 and around the steam discharge ducts 29, so as to heat the latter, before being redirected towards the second diffusion chamber 25 by the lower wall 35 of the inner chamber 21. Finally, the steam flows through the steam discharge ducts 29 and is distributed to the outside of the smoothing head 6, through the steam outlet holes 13.

The presence of the elbow 22 upstream of the outlet opening 19 causes an acceleration of the steam flow flowing into the inlet duct 17, and thus favors the separation of the water drops which are carried by the steam flow, from the steam flow, while the configuration of the outlet opening 19 ensures blowing, by the steam flow, of the separated water drops along the front wall 10 and towards the condensate evacuation opening 33, where the latter are evacuated into the condensate storage cavity 36.

In addition, the shape of the steam discharge ducts 29 and the fact that the latter include lower openings 32 allow the condensates that may have formed in the steam discharge ducts 29 (such formation being limited because of the prior heating of the steam discharge ducts 29 by the steam flowing into the first diffusion chamber 23) to fall by gravity into the inner chamber 21 and to be evacuated out of the latter via the condensate evacuation opening 33.

The condensates contained in the condensate storage cavity 36 are then redirected toward the steam pipe 7, via the return duct 38, so that the condensates slide by gravity along the steam pipe 7, and fall back into the steam generator 5 of the base unit 3 where they will then be revaporized.

Figure 8:
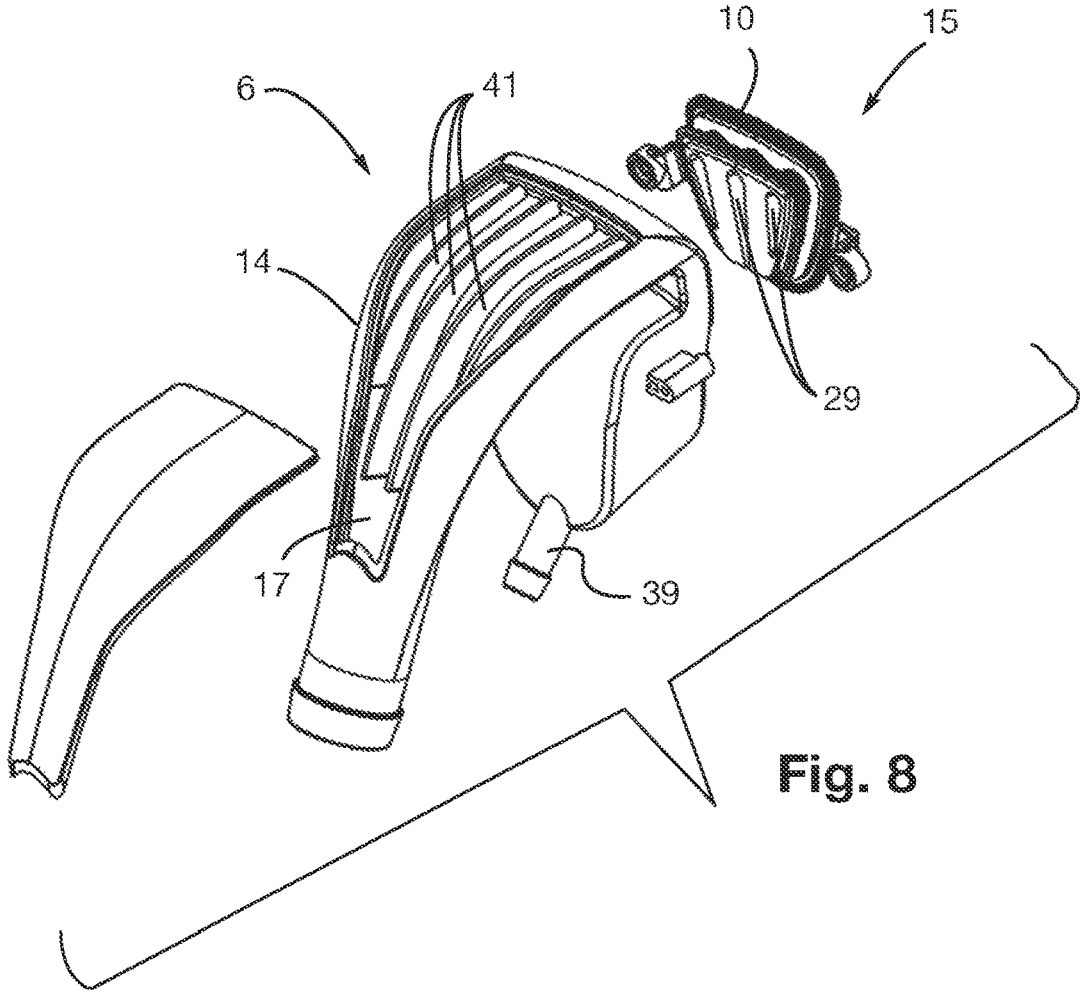
FIG. 8 is am exploded perspective view of a smoothing head according to a second embodiment of the invention.

FIG. 8 represents a smoothing head 6 according to a second embodiment of the invention, in which the condensate return circuit 34 comprises a connection 39 provided on the smoothing head 6 and connected to the condensate storage cavity 36, the connection 39 being intended to be connected to a return pipe connected to the base unit 3, and for example to the steam generator 5, and in which the inlet duct 17 comprises at least one guiding rib 41 extending along the inlet duct 17 and configured to guide the steam flowing into the inlet duct 17. Beneficially, the inlet duct 17 comprises a plurality of guiding ribs 41 extending along the inlet duct 17.

It will be appreciated that the invention is in no way limited to the embodiments described and illustrated, which have been provided only as examples. Modifications are still possible, in particular from the point of view of composition of the various components or by substitution of equivalent techniques, without departing from the scope of protection of the invention.

The invention claimed is:

1. A smoothing head comprising a steam distribution circuit and a front wall equipped with a treatment face intended to face a garment to be smoothed, the treatment face comprising at least one steam outlet hole, the steam distribution circuit comprising an inlet duct including an inlet opening intended to be connected to a steam pipe, the steam distribution circuit also comprising an inner chamber, the inlet duct comprising an outlet opening leading to the inner chamber, the inner chamber comprising a condensate evacuation opening communicating with a condensate return circuit, wherein the condensate return circuit is configured to lead to the steam pipe or to the inlet duct, and wherein the smoothing head further comprises a partition wall extending parallel to the front wall configured so as to direct steam emitting from the outlet opening of the inlet duct along the front wall prior to entering the at least one steam outlet hole, wherein the inlet duct has a 90° elbow upstream of the outlet opening, and wherein the elbow has an inner bend radius of between 3.5 and 4.5 mm and an outer bend radius of between 9 and 11 mm.

2. The smoothing head according to claim 1, wherein the outlet opening leads to an upper part of the inner chamber.

3. The smoothing head according to claim 1, wherein the inner chamber comprises a first diffusion chamber arranged between an inner face of the front wall and a first face of the partition wall extending inside the inner chamber, and a second diffusion chamber partially defined by a second face of the partition wall opposite the first face of the partition wall, the second diffusion chamber being in communication with the first diffusion chamber.

4. The smoothing head according to claim 3, wherein the first diffusion chamber has a flow cross section gradually diminishing according to the direction of circulation of the steam in the first diffusion chamber.

5. The smoothing head according to claim 1, wherein a plurality of steam discharge ducts extend transversely to the front wall and communicate with the at least one steam outlet hole such that the steam in the inner chamber escapes through the plurality of steam discharge ducts and towards the at least one steam outlet hole.

6. The smoothing head according to claim 5, wherein the inner chamber comprises a first diffusion chamber arranged between an inner face of the front wall and a first face of the partition wall extending inside the inner chamber, and a second diffusion chamber partially defined by a second face of the partition wall opposite the first face of the partition wall, the second diffusion chamber being in communication with the first diffusion chamber, and wherein the first diffusion chamber is crossed by the plurality of steam discharge ducts, the plurality of steam discharge ducts projecting from the inner face of the front wall and leading to the second diffusion chamber.

7. The smoothing head according to claim 5, wherein the treatment face comprises several steam outlet holes, and each steam discharge duct coincides with a respective steam outlet hole.

8. The smoothing head according to claim 5, wherein the steam discharge ducts have a total cross section area corresponding to a cross section area of the inlet duct.

9. The smoothing head according to claim 5, wherein each steam discharge duct comprises a barrier rib which projects inside said steam discharge duct and forms a barrier against a flow of water drops along said steam discharge duct towards the at least one steam outlet hole.

10. The smoothing head according to claim 1, wherein the inner chamber includes a lower wall comprising the condensate evacuation opening.

11. The smoothing head according to claim 10, wherein the lower wall is curved.

12. The smoothing head according to claim 1, wherein the condensate return circuit comprises a condensate storage cavity arranged in the smoothing head.

13. The smoothing head according to claim 1, wherein the condensate return circuit comprises a return duct including a first extremity portion connected fluidically to the condensate evacuation opening, and a second extremity portion opposite the first extremity portion and configured to project into the steam pipe or into the inlet duct.

14. The smoothing head according to claim 1, further comprising a main body at least partially defining the inner chamber, and a soleplate connected to the main body and including the front wall.

15. A smoothing apparatus comprising a base unit provided with a steam generator and a smoothing head according to claim 1.

16. A smoothing head comprising a steam distribution circuit and a front wall equipped with a treatment face intended to face a garment to be smoothed, the treatment face comprising at least one steam outlet hole, the steam distribution circuit comprising an inlet duct including an inlet opening intended to be connected to a steam pipe, the steam distribution circuit also comprising an inner chamber, the inlet duct comprising an outlet opening leading to the inner chamber, the inner chamber comprising a condensate evacuation opening communicating with a condensate return circuit, wherein the condensate return circuit is configured to lead to the steam pipe or to the inlet duct, wherein the smoothing head further comprises a partition wall extending parallel to the front wall configured so as to direct steam emitting from the outlet of the inlet duct along the front wall prior to entering the at least one steam outlet hole, and wherein the outlet opening leads to the inner chamber tangentially to the front wall, such that the steam exiting the outlet opening flows along the front wall.

17. The smoothing head according to claim 16, wherein a plurality of steam discharge ducts extend transversely to the front wall and communicate with the at least one steam outlet hole such that the steam in the inner chamber escapes through the plurality of steam discharge ducts and towards the at least one steam outlet hole.

18. The smoothing head according to claim 16, wherein the inner chamber includes a lower wall comprising the condensate evacuation opening.

19. The smoothing head according to claim 16, wherein the condensate return circuit comprises a condensate storage cavity arranged in the smoothing head.

20. A smoothing head comprising a steam distribution circuit and a front wall equipped with a treatment face intended to face a garment to be smoothed, the treatment face comprising at least one steam outlet hole, the steam distribution circuit comprising an inlet duct including an inlet opening intended to be connected to a steam pipe, the steam distribution circuit also comprising an inner chamber, the inlet duct comprising an outlet opening leading to the inner chamber, the inner chamber comprising a condensate evacuation opening communicating with a condensate return circuit, wherein the condensate return circuit is configured to lead to the steam pipe or to the inlet duct, and wherein the smoothing head further comprises a partition wall extending parallel to the front wall configured so as to direct steam emitting from the outlet opening of the inlet duct along the front wall prior to entering the at least one steam outlet hole, wherein a plurality of steam discharge ducts extend transversely to the front wall and communicate with the at least one steam outlet hole such that the steam in the inner chamber escapes through the plurality of steam discharge ducts and towards the at least one steam outlet hole, and wherein the inner chamber comprises a first diffusion chamber arranged between an inner face of the front wall and a first face of the partition wall extending inside the inner chamber, and a second diffusion chamber partially defined by a second face of the partition wall opposite the first face of the partition wall, the second diffusion chamber being in communication with the first diffusion chamber, and wherein the first diffusion chamber is crossed by the plurality of steam discharge ducts, the plurality of steam discharge ducts projecting from the inner face of the front wall and leading to the second diffusion chamber.

* * * * *